US011105310B2

(12) United States Patent
Ohta

(10) Patent No.: US 11,105,310 B2
(45) Date of Patent: Aug. 31, 2021

(54) CONTROL DEVICE

(71) Applicant: ISUZU MOTORS LIMITED, Tokyo (JP)

(72) Inventor: Tomoko Ohta, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 16/759,611

(22) PCT Filed: Oct. 19, 2018

(86) PCT No.: PCT/JP2018/038988
§ 371 (c)(1),
(2) Date: Apr. 27, 2020

(87) PCT Pub. No.: WO2019/082807
PCT Pub. Date: May 2, 2019

(65) Prior Publication Data

US 2020/0271082 A1 Aug. 27, 2020

(30) Foreign Application Priority Data

Oct. 27, 2017 (JP) ..... JP2017-208140

(51) Int. Cl.
*F02N 11/08* (2006.01)

(52) U.S. Cl.
CPC ..... *F02N 11/0862* (2013.01); *F02N 11/0803* (2013.01); *F02N 11/087* (2013.01); *F02N 2200/063* (2013.01); *F02N 2250/02* (2013.01)

(58) Field of Classification Search
CPC .. F02N 2250/02; F02N 11/08; F02N 11/0862; F02N 11/087; F02N 11/0803
(Continued)

(56) References Cited

U.S. PATENT DOCUMENTS

2007/0129863 A1* 6/2007 Hsu ..... G08G 1/168 701/36
2007/0137602 A1* 6/2007 Kassner ..... F02N 15/04 123/179.25

(Continued)

FOREIGN PATENT DOCUMENTS

JP 2003118415 A 4/2003
JP 2003286873 A 10/2003

(Continued)

OTHER PUBLICATIONS

International Search Report and Written Opinion for related PCT App No. PCT/JP2018/038988 dated Dec. 25, 2018, 7 pgs. (partial translational).

*Primary Examiner* — John Kwon
*Assistant Examiner* — Johnny H Hoang
(74) *Attorney, Agent, or Firm* — Procopio, Cory, Hargreaves & Savitch LLP

(57) ABSTRACT

A control device includes an engine starting unit that starts an engine on a condition that a first voltage is supplied, an engine control unit that controls an operation of the engine starting unit, and a transmission control unit that drives a transmission on a condition that a second voltage, which is higher than the first voltage, is supplied. The transmission control unit sends an engine start permission signal to the engine control unit in a case where a voltage of power supplied from a battery is the second voltage or higher, and the engine control unit permits the engine starting unit to start the engine on a condition that the engine control unit receives the engine start permission signal.

4 Claims, 5 Drawing Sheets

(58) Field of Classification Search
USPC ..... 701/102, 110–113; 123/179.4
See application file for complete search history.

(56) References Cited

U.S. PATENT DOCUMENTS

| | | | | |
|---|---|---|---|---|
| 2013/0207609 | A1* | 8/2013 | Emori | B60L 58/19<br>320/116 |
| 2013/0261865 | A1* | 10/2013 | Toki | B60W 20/13<br>701/22 |

FOREIGN PATENT DOCUMENTS

| | | | |
|---|---|---|---|
| JP | 2009293451 | A | 12/2009 |
| JP | 2011021566 | A | 2/2011 |
| JP | 2015075163 | A | 4/2015 |

* cited by examiner

CONTROL DEVICE

CROSS-REFERENCE TO RELATED APPLICATIONS

This application is a U.S. National Stage entry of PCT Application No: PCT/JP2018/038988 filed Oct. 19, 2018, which claims priority to Japanese Patent Application No. 2017-208140, filed Oct. 27, 2017, the contents of which are incorporated herein by reference.

TECHNICAL FIELD

The present disclosure relates to a control device that controls starting of an engine of a vehicle.

BACKGROUND ART

An engine starting motor that is driven by power of a battery is used to start an engine of a vehicle. It is known that a voltage of the battery drops when the engine starting motor is driven (for example, see Patent Literature 1).

CITATION LIST

Patent Document

Patent Literature 1: JP-A-2009-293451

SUMMARY OF THE INVENTION

Technical Problem

In a vehicle which is a truck or the like, a drive voltage required to start the engine may be different from a drive voltage required to drive a mechanism other than the engine. In a case where the drive voltage for driving the mechanism other than the engine is higher than the drive voltage for starting the engine, it may be difficult to drive the mechanism (for example, a transmission or a braking system) other than the engine depending on a state of the storage battery even if the engine can be started. In this case, even if the engine of the vehicle can be started, if the mechanism other than the engine cannot be driven, control of the vehicle may be hindered.

An aspect of the present disclosure provides a control device capable of improving safety after starting an engine of a vehicle.

Solution to Problem

An aspect of the present disclosure is a control device mounted on a vehicle.

The control device includes:

an engine starting unit that starts an engine of the vehicle on a condition that power having a voltage higher than a first drive voltage is supplied;

an engine control unit that controls an operation of the engine starting unit; and a transmission control unit that drives a transmission of the vehicle on a condition that power having a voltage higher than a second drive voltage which is higher than the first drive voltage is supplied.

Here, the transmission control unit sends an engine start permission signal to the engine control unit in a case where a voltage of power supplied from a battery of the vehicle is the second drive voltage or higher, and the engine control unit permits the engine starting unit to start the engine on a condition that the engine control unit receives the engine start permission signal sent from the transmission control unit.

The transmission control unit may measure a voltage value of power supplied from the battery at a predetermined time interval to update the voltage value as a current value, the control device may further include an ignition switch that receives an instruction from a driver of the vehicle for supplying power of the battery to the engine starting unit, the engine control unit, and the transmission control unit, and the transmission control unit may stop updating the voltage value until a predetermined first update waiting time elapses since a supply of power from the battery starts.

The ignition switch may further receive an instruction for starting the engine from the driver, the engine control unit may send a start instruction signal to the transmission control unit while the ignition switch receives the start instruction, and while the transmission control unit receives the start instruction signal, the transmission control unit may set a voltage value obtained by subtracting a predetermined reference voltage threshold from the voltage value before the update as the voltage value after the update in a case where a measured value of the voltage value after the update is lower than the voltage value before the update by the reference voltage threshold or more.

The transmission control unit may stop updating the voltage value until a predetermined second update waiting time elapses since the reception of the start instruction signal is completed.

Advantageous Effects of Invention

According to the present disclosure, it is possible to improve safety after starting an engine of a vehicle.

DESCRIPTION OF EMBODIMENTS

Outline of Embodiment

An outline of an embodiment will be described. A control device according to the embodiment is mounted on a vehicle including an automated manual transmission (AMT), and is configured to control starting of an engine. The AMT is a transmission in which an action of a sleeve for clutch operation and gear selection in a manual transmission (MT) has been automated, using an actuator. In the vehicle mounted with the control device according to the embodiment, a first drive voltage, which is a drive voltage of a starter motor used for starting the engine, is different from a second drive voltage which is a drive voltage of the actuator of the AMT.

Specifically, in the vehicle mounted with the control device according to the embodiment, the first drive voltage is, for example, 10.5 [V], and the second drive voltage is, for example, 18 [V]. Accordingly, the first drive voltage is lower than the second drive voltage. Therefore, if a voltage of a battery mounted on the vehicle exceeds the first drive voltage, the control device can drive the starter motor to start the engine even when the voltage of the battery is lower than the second drive voltage. However, in a case where the AMT which is the transmission cannot be driven even if the engine can be started, the control device does not start the engine of the vehicle.

Therefore, the control device according to the embodiment sets a condition for starting the engine that the voltage of the battery mounted on the vehicle is the second drive voltage or higher. In other words, the control device according to the embodiment permits the engine to start when the voltage of the battery is the second drive voltage or higher, and prohibits the engine from starting in a case where the voltage of the battery is lower than the second drive voltage.

Accordingly, the control device according to the embodiment can ensure that the transmission can be driven alter the engine has been started. Therefore, the control device according to the embodiment can avoid a situation in which, for example, the engine is started in a state in which the clutch has been connected and the clutch cannot be disconnected. As a result, the control device according to the embodiment can improve safety after starting the engine of the vehicle.

Functional Configuration of Control Device 1 and Vehicle

Figure 1:
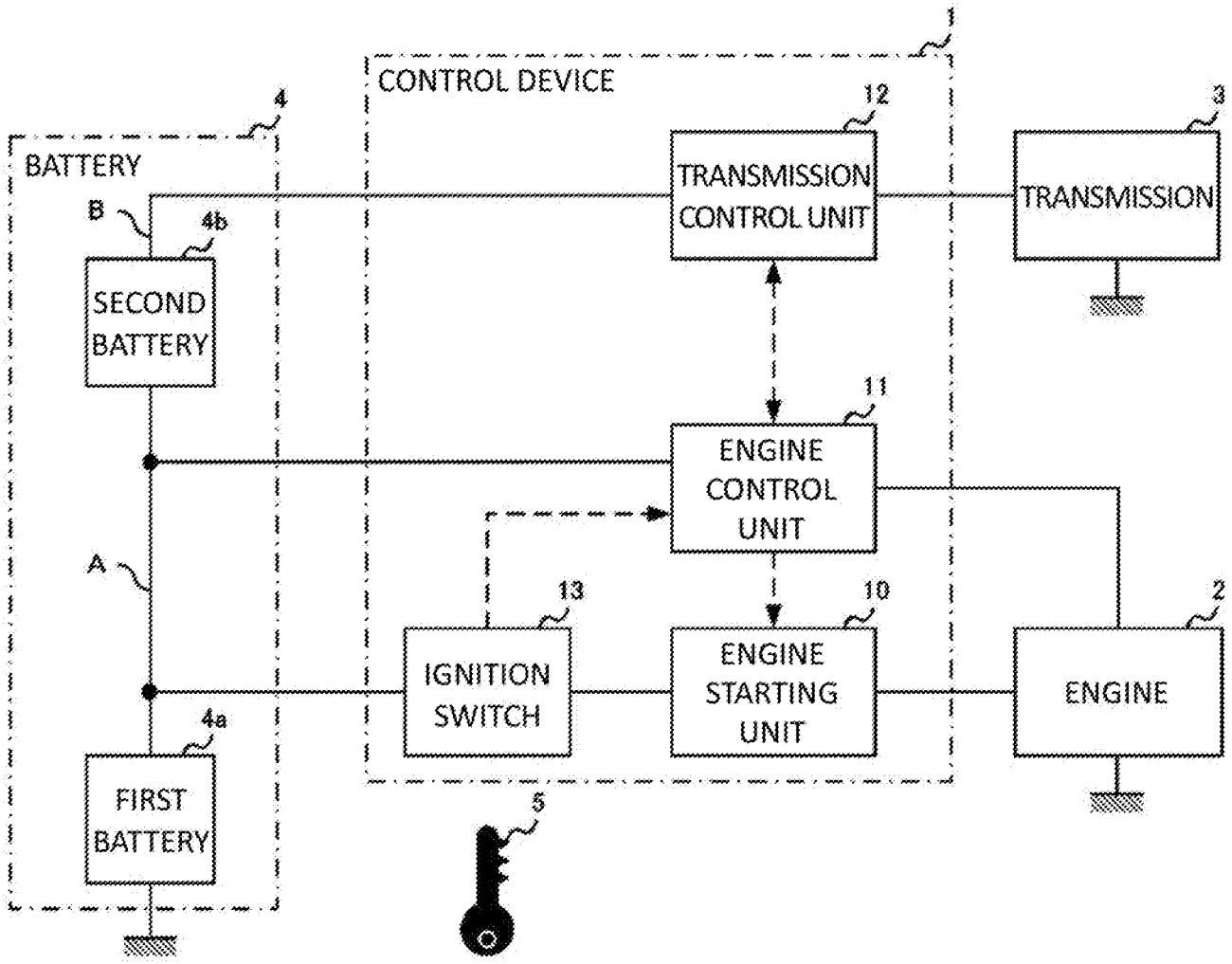
FIG. 1 schematically shows a functional configuration of a control device and a functional configuration of a vehicle related to the control device according to an embodiment.

FIG. 1 schematically shows a functional configuration of a control device 1 and a functional configuration of a vehicle related to the control device 1 according to the embodiment. FIG. 1 shows the configuration showing the control device 1 according to the embodiment, and other configurations are omitted.

The vehicle mounted with the control device 1 according to the embodiment includes an engine 2, a transmission 3, and a battery 4. The control device 1 includes an engine starting unit 10, an engine control unit 11, a transmission control unit 12, and an ignition switch 13, and the battery 4 includes a first battery 4*a* and a second battery 4*b*. In FIG. 1, a solid line connecting each unit indicates art electrical connection, and a broken line indicates a connection based on communication.

In the battery 4, the first battery 4*a* and the second battery 4*b* each having a voltage of 12 [V] are connected in series. Therefore, in a case where the battery 4 is sufficiently charged, a voltage of a circuit including a conductive wire A between the first battery 4*a* and the second battery 4*b* is 12 [V]. A voltage of a circuit including a conductive wire B on a positive electrode side of the second battery 4*b* is 24 [V]. As shown in FIG. 1, the engine starting unit 10, the engine control unit 11, and the ignition switch 13 of the control device 1 are applied with the voltage from the first battery 4*a*, and the transmission control unit 12 is applied with a combined voltage of the first battery 4*a* and the second battery 4*b*.

The ignition switch 13 is configured to start or stop energization of an electric system provided in the vehicle, or to start or stop the engine 2 of the vehicle. The ignition switch 13 shown in FIG. 1 shows an example in which a driver of the vehicle controls the energization of the electric system and starting of the engine 2 by inserting into a key cylinder (not shown) provided in the ignition switch 13 and turning the engine key 5. Although not shown, the ignition switch 13 according to the embodiment may be a push start type in which a button is pressed.

In a case where the ignition switch 13 is off, the battery 4 and the control device 1 are electrically disconnected. When the driver of the vehicle inserts the engine key 5 into the ignition switch 13 and turns the engine key 5, first, the voltage of the battery 4 shifts to an energized state in which the engine starting unit 10, the engine control unit 11, the transmission control unit 12, and the ignition switch 13 are energized. In this state, when the driver turns the engine key 5 further, the engine starting unit 10, which is a starter motor, operates to start the engine 2.

Here, the engine starting unit 10 starts the engine 2 of the vehicle on a condition that power having a voltage higher than the first drive voltage is supplied from the battery 4. The engine control unit 11 controls an operation of the engine 2 which is an internal combustion engine. Therefore, the engine control unit 11 controls the starting of the engine 2 by controlling the operation of the engine starting unit 10.

The transmission control unit 12 drives the transmission 3 of the vehicle on a condition that power having a voltage higher than the second drive voltage which is higher than the first drive voltage is supplied from the battery 4. Here, the transmission control unit 12 acquires the voltage of the power supplied from the battery 4 as soon as the transmission control unit 12 is energized. Therefore, the transmission control unit 12 includes a voltmeter (not shown) therein.

When energized, the transmission control unit 12 measures a voltage value of the battery 4 at a predetermined time interval and updates the voltage value as a "current value". Here, the "predetermined time interval" is a voltage value update reference interval that is referred to when the transmission control unit 12 acquires the voltage value of the battery 4. A value of the voltage value update reference interval may be determined experimentally in consideration of voltage characteristics of the battery 4, characteristics of the electric system provided in the vehicle, and the like, and is, for example, 20 milliseconds.

In a case where the voltage of the power supplied from the battery 4 is the second drive voltage or higher, the transmission control unit 12 sends an engine start permission signal to the engine control unit 11 via a communication network. The communication network is implemented by a known controller area network (CAN).

The engine control unit 11 causes the engine starting unit 10 to start the engine 2 on a condition that the engine control unit 11 receives the engine start permission signal sent from the transmission control unit 12. In other words, in the case where the engine control unit 11 receives the engine start permission signal sent from the transmission control unit 12, the engine control unit 11 permits the engine starting unit 10 to start the engine 2. On the other hand, in the case where the engine control unit 11 does not receive the engine start permission signal sent from the transmission control unit 12, the engine control unit 11 prohibits the engine starting unit 10 from starting the engine 2.

Accordingly, the control device 1 does not start the engine 2 in the case where it is not confirmed that the second drive voltage for controlling the transmission 3 is provided. As a result, the control device 1 can prevent the engine 2 from starting in a state in which the transmission 3 cannot be controlled, and can improve the safety after starting the engine of the vehicle.

As described above, the ignition switch 13 is a mechanism liar receiving an instruction from the driver of the vehicle for supplying the power of the battery 4 to the engine starting unit 10, the engine control unit 11, and the transmission control unit 12. The ignition switch 13 has four states of "off", "accessory", "on", and "start" according to a rotation angle of the engine key 5.

The "off" state is a state in which the battery 4 and the control device 1 are electrically disconnected. The "accessory" is a state in which the electric system (for example, car audio or the like) that is not necessary for traveling of the vehicle is energized. The "on" is a state in which the engine starting unit 10 is also energized. The "start" is a so-called "cranking state" in which the engine starting unit 10 is operated to attempt to start the engine 2, that is, a state m Which a start instruction of the engine 2 from the driver is received.

The engine control unit 11 acquires, via the communication network, whether the ignition switch 13 is in the "accessory" state, the "on" state, or the "start" state. Then, the engine control unit 11 sends the state of the ignition switch 13 to the transmission control unit 12. Thus, the transmission control unit 12 can detect that the engine starting unit 10 is using the power of the battery 4 for starting the engine 2. In particular, the engine control unit 11 continues to send a start instruction signal to the transmission control unit 12 while the ignition switch 13 receives the start instruction from the driver. Accordingly, the transmission control unit 12 can detect that the engine starting unit 10 is operating.

Here, it takes approximately several hundred milliseconds by the time communication via the communication network becomes possible since the control device 1 is energized. Therefore, it takes approximately several hundred milliseconds by the time communication between the engine control unit 11 and the transmission control unit 12 and communication between the engine control unit 11 and the ignition switch 13 are started since the control device 1 is energized. On the other hand, when the driver of the vehicle inserts the engine key 5 into the ignition switch 13 and performs so-called "one time shifting" of shifting the engine key 5 to the "start" state at one time, the engine starting unit 10 operates earlier than starting of the communication network in the control device 1.

In general, when the engine starting unit 10 operates and consumes the power of the battery 4, the voltage of the engine 2 temporarily drops. If the transmission control unit 12 can detect that the state of the ignition switch 13 is the "start" state via the engine control unit 11, the temporary voltage drop of the engine 2 can also be ignored. However, when the driver of the vehicle performs one time shifting, the voltage drop of the battery 4 may start before the transmission control unit 12 detects the state of the ignition switch 13.

In this case, when the voltage of the battery 4 becomes lower than the second drive voltage due to the voltage drop of the battery 4, the transmission control unit 12 stops sending the start permission signal to the engine control unit 11. As a result, the engine control unit 11 stops the operation of the engine starting unit 10. When the operation of the engine starting unit 10 stops, the voltage of the hatter 4 returns to an original state thereof, and the transmission control unit 12 sends the start permission signal to the engine control unit 11 again. Therefore, the voltage of the battery 4 drops due to the operation of the engine starting unit 10, and thereafter the same operation may be repeated.

Therefore, the transmission control unit 12 stops updating the voltage value of the battery 4 until a predetermined first update waiting time elapses since the supply of power from the battery 4 is started to energize the transmission control unit 12. Therefore, the transmission control unit 12 maintains the voltage value of the battery 4 acquired immediately after the energized state as the current value until the first update waiting time elapses since the transmission control unit 12 is energized.

Here, the "first update waiting time" is "energization start time update reference time" that is referred to when the transmission control unit 12 acquires the voltage value of the battery 4 next time after the transmission control unit 12 has been energized and has first acquired the voltage value of the battery 4. The transmission control unit 12 is based on updating the voltage of the battery 4 at the above-described voltage value update reference interval. However, the transmission control unit 12 updates the voltage after the elapse of the first update waiting time immediately after being energized so as to appropriately send the start permission signal in a case where the driver of the vehicle performs one time shifting. Therefore, the first update waiting time is longer than the voltage value update reference interval, and is, for example, 2 seconds.

Figure 2:
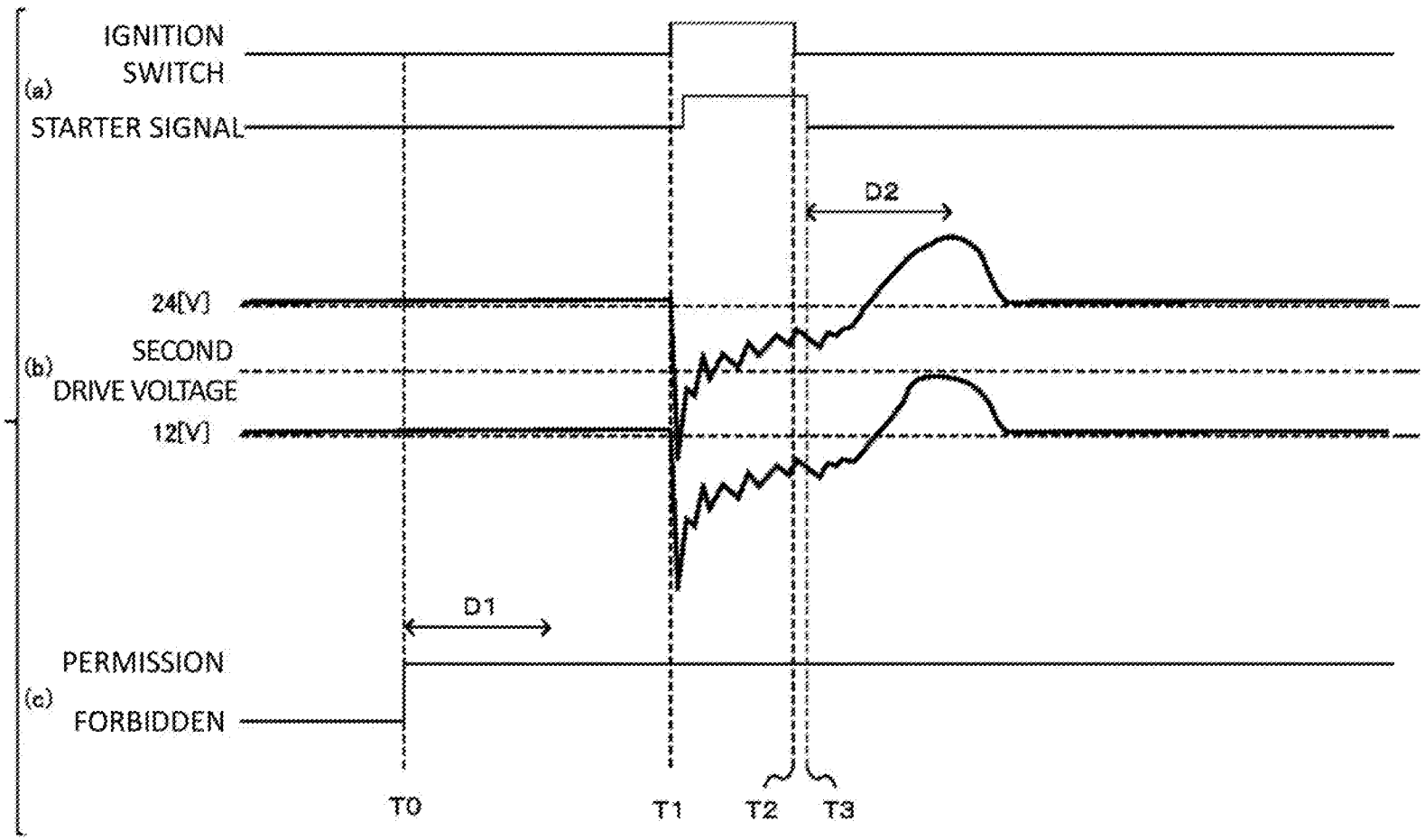
FIG. 2 schematically shows changes over time in a state of an ignition switch, a voltage of a battery, and a state of a start permission signal.

FIG. 2 schematically shows changes over time in the state of the ignition switch 13, the voltage of the battery 4, and a state of the start permission signal. Specifically, an upper part of (a) of FIG. 2 shows whether the ignition switch 13 is in the "start state", and a lower part of FIG. 2 shows a signal that is sent from the engine control unit 11 and received by the transmission control unit 12 and indicates the "start state" of the ignition switch 13. As shown in (a) of FIG. 2, a time lag based on a communication delay is generated between a timing at which the ignition switch 13 is in the "start state" and the state signal sent from the engine control unit 11 and received by the transmission control unit 12.

An upper part of (b) of FIG. 2 shows a change over time in the voltage of the circuit including the conductive wire B on the positive electrode side of the second battery 4*b*, and a lower part of (b) of FIG. 2 shows a change over time in the voltage of the circuit including the conductive wire A between the first battery 4*a* and the second battery 4*b*. As shown in (b) of FIG. 2, at a time T1 when the state of the ignition switch 13 becomes the "start state", the voltage of the circuit including the conductive wire A and the voltage of the circuit including the conductive wire B drop temporarily and sharply with the operation of the engine starting unit 10. As a result, the voltage of the circuit including the conductive wire B on the positive electrode side of the second battery 4*b* is temporarily lower than the second drive voltage. For a while after the time T1, the voltage of the battery 4 fluctuates due to the operation of the ignition switch 13.

(c) of FIG. 2 shows whether the transmission control unit 12 sends the start permission signal to the engine control unit 11. In FIG. 2, a time T0 indicates a time when the control device 1 is energized. As shown in (b) of FIG. 2, the voltage of the circuit including the conductive wire B exceeds the second drive voltage at the time T0, so that the transmission control unit 12 sends the start permission signal to the engine control unit 11. In (c) of FIG. 2, a period indicated by a reference numeral D1 is the above-described first update waiting time D1. The engine control unit 11 stops updating the voltage of the battery 4 until the first update waiting time D1 elapses after the engine control unit 11 has been energized.

If the driver of the vehicle performs one time shifting, the time T0 and the time T1 in FIG. 2 are close to each other. In this case, the voltage drop of the battery 4 occurs during the first update waiting time D1. The update of the voltage value of the battery 4 performed by the transmission control unit 12 is stopped until the first update waiting time elapses, so that the "current value" of the voltage of the battery 4 is maintained at the voltage value immediately after the energization. As a result, the transmission control unit 12 can prevent the sending of the start permission signal from being stopped due to the temporary voltage drop of the battery 4 associated with the operation of the engine starting unit 10.

The voltage drop of the battery 4 associated with the operation of the engine starting unit 10 is temporary, so that the transmission control unit 12 may stop updating the voltage value of the battery 4 during the operation of the engine starting unit 10. However, when the voltage of the battery 4 is permanently lower than the first drive voltage for some reason, the engine 2 cannot be started, and the operation state of the engine starting unit 10 is continued. When stopping updating the voltage value of the battery 4 during the operation of the engine starting unit 10, the transmission control unit 12 cannot start updating the voltage value in a case where the voltage of the battery 4 permanently drops.

Therefore, even when the engine starting unit 10 is operating, the transmission control unit 12 continues to update the voltage value of the battery 4. However, the transmission control unit 12 executes the "voltage update processing during reception of the instruction signal" while the transmission control unit 12 receives the start instruction signal from the engine control unit 11.

Specifically, while the transmission control unit 12 receives the start instruction signal from the engine control unit 11, the transmission control unit 12 sets V0−Vt, which is a voltage value obtained by subtracting a predetermined reference voltage threshold Vt from a voltage value V0 of the battery 4 before the update, as a voltage value V1 of the battery 4 after the update in a case where a measured value of the voltage value of the battery 4 after the update is lower than the voltage value V0 of the battery 4 before the update by the reference voltage threshold Vt or more. That is, while the transmission control unit 12 receives the start instruction signal from the engine control unit 11, the transmission control unit 12 limits an amount of the drop associated with the update of the voltage value of the battery 4.

Here, the "reference voltage threshold" is a lower limit value of an update amount when the transmission control unit 12 updates the voltage value of the battery 4 in a dropping direction in the voltage update processing during the reception of the instruction signal. The reference voltage threshold may be determined experimentally in consideration of performance of the battery 4, power consumption of the ignition switch 13, and the like, and is, for example, 0.5 V.

For example, the voltage value V0 of the battery 4 before the update is 24 V, and the measured value of the voltage value of the battery 4 after the update is 19 V. In this case, the voltage value becomes 5 V that is obtained by subtracting the voltage value V0 from the measured value. However, in this case, the measured value drops b a voltage value higher than 0.5 V which is the reference voltage threshold. Therefore, the transmission control unit 12 sets the voltage value V1 of the battery 4 after the update as V1=V0−Vt=23.5 V.

In the case where the voltage drop of the battery 4 is temporary, the voltage of the battery 4 returns to an initial value over time. Therefore, it is considered that the voltage of the battery 4 does not fall below the second drive voltage in a course of the voltage update processing during the reception of the instruction signal. On the other hand, in the case where the voltage drop of the battery 4 is permanent, even if the update amount of the voltage of the battery 4 is limited to the reference voltage threshold, the voltage of the battery 4 eventually falls below the second drive voltage. Therefore, the transmission control unit 12 can detect that the voltage drop of the battery 4 is permanent, and can stop sending the start permission signal to the engine control unit 11.

In a case where the measured value of the voltage value of the battery 4 after the update is higher than the voltage value V0 of the battery 4 before the update, the transmission control unit 12 sets the measured value as the voltage value V1 of the battery 4 after the update. This is because an increase in the voltage of the battery 4 does not hinder control processing of the control device 1.

In FIG. 2, a time T2 indicates a time when the driver of the vehicle returns the state of the control device 1 from the start state to the on state. Due to the time lag of the communication network, the transmission control unit 12 stops sending the start instruction signal by the engine control unit 11 at a time T3 that is slightly later than the time T2.

As shown in FIG. 2, immediately after the driver of the vehicle returns the state of the ignition switch 13 from the start state to the on state, the engine starting unit 10 operates for a while, and die voltage of the battery 4 also changes accordingly. Therefore, the transmission control unit 12 stops updating the voltage value of the battery 4 until a predetermined second update waiting time D2 elapses since the reception of the start instruction signal sent from the engine control unit 11 is completed.

Here, the "second update waiting time" is "cranking end time update reference time" that is referred to when the voltage value of the battery 4 is acquired next time after the state of the ignition switch 13 has been changed from the start state to the on state. The second update waiting time may be determined experimentally in consideration of the voltage characteristics of the battery 4, the power used by the ignition switch 13, and the like, and is, for example, 2 seconds which is the same as the first update waiting time.

The transmission control unit 12 waits for the update of the voltage value of the battery 4 until the second update waiting time elapses when the transmission control unit 12 acquires the voltage value of the battery 4 next time after the state of the ignition switch 13 has been changed from the start state to the on state. Accordingly, when the voltage value of the battery 4 is updated, the transmission control unit 12 can prevent an influence of the fluctuation of the voltage value of the battery 4 associated with the continuation of the operation of the engine starting unit 10. As a result, the transmission control unit 12 can acquire the voltage value of the battery 4 with good accuracy.

Processing Flow of Control Processing Executed by Control Device 1

Figure 3:
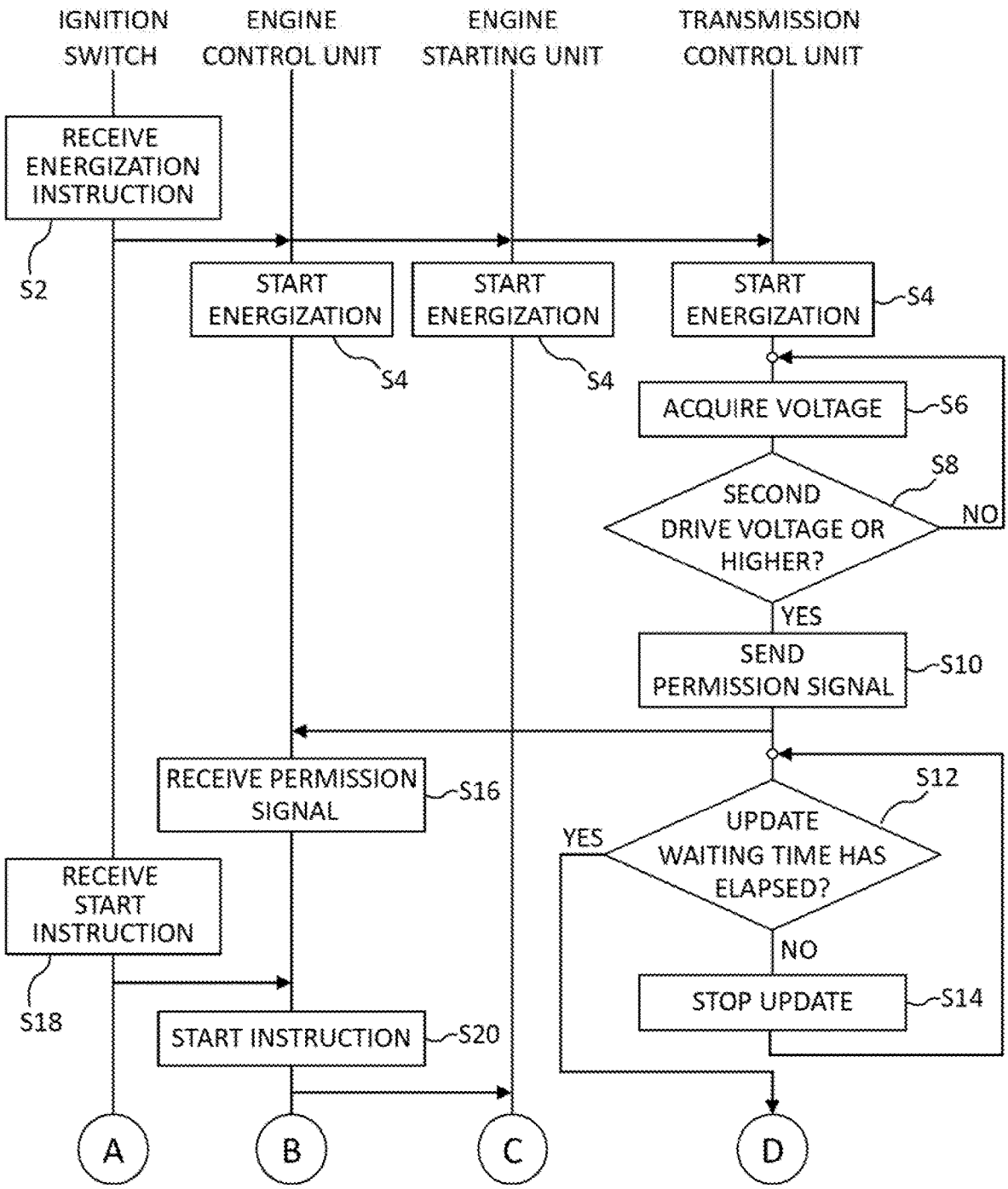
FIG. 3 shows a former half of a sequence diagram showing a flow of control processing executed by the control device according to the embodiment.
Figure 4:
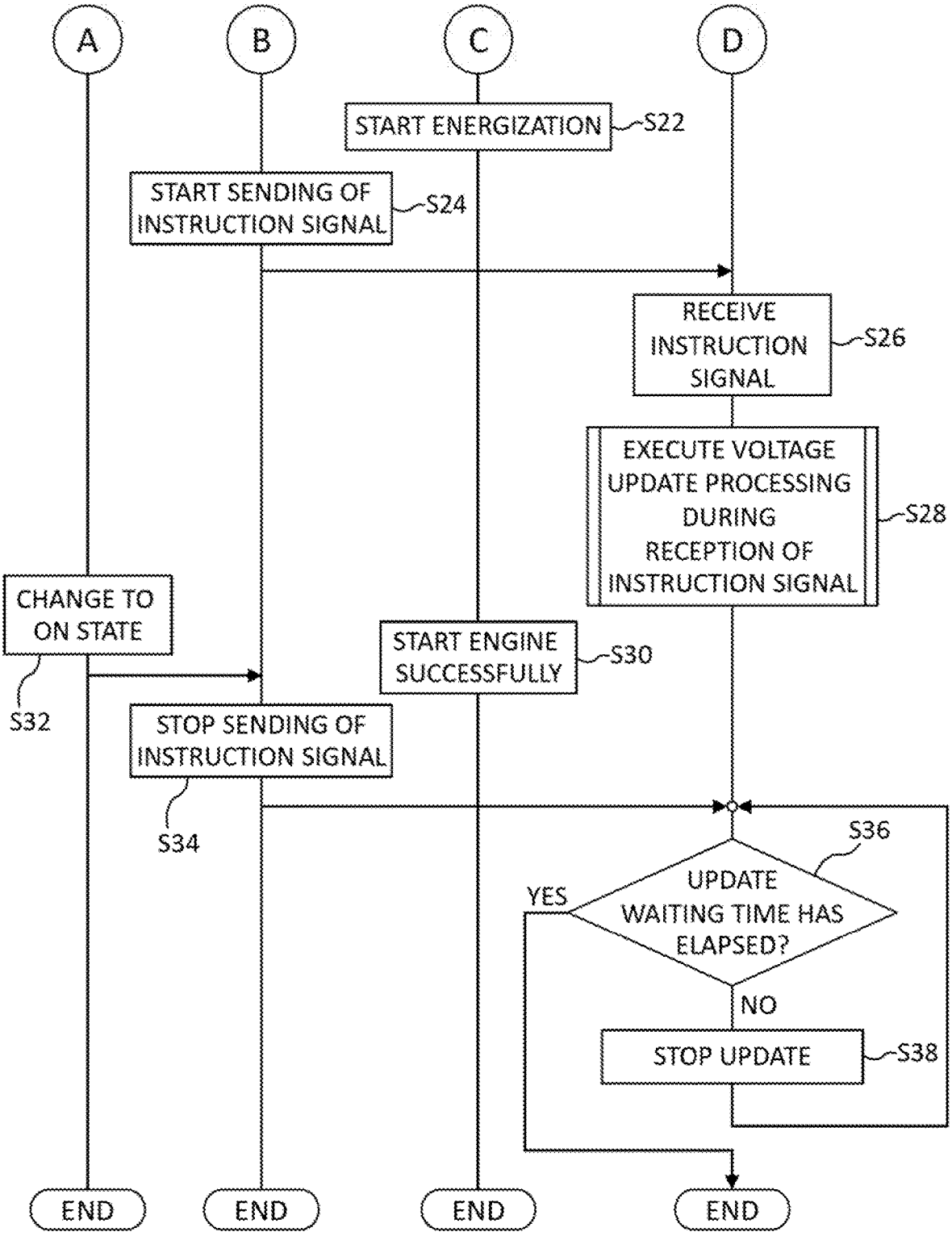
FIG. 4 shows a latter half of the sequence diagram showing the flow of the control processing executed by the control device according to the embodiment.

FIGS. 3 and 4 are sequence diagrams showing a flow of the control processing executed by the control device 1 according to the embodiment. Specifically, FIG. 3 shows a former half of a sequence diagram showing the flow of the control processing executed by the control device 1 according to the embodiment, and FIG. 4 shows a latter half of the sequence diagram showing the flow of the control processing executed by the control device 1 according to the embodiment.

First, the former half of the sequence diagram will be described with reference to FIG. 3. When the driver of the vehicle operates the engine key 5 to turn on the ignition switch 13, the ignition switch 13 receives an energization instruction for energizing the control device 1 from the driver (S2). As a result, the engine starting unit 10, the engine control unit 11, and the transmission control unit 12 each receive the power supplied from the battery 4, and start to be energized (S4).

The transmission control unit 12 acquires the voltage of the battery 4 when energized (S6). While the voltage of the battery 4 is lower than the second drive voltage (No in S8), the transmission control unit 12 returns to step S6 and continues to acquire the voltage of the battery 4. In the case where the voltage of the battery 4 is the second drive voltage or higher (Yes in S8), the transmission control unit 12 sends the start permission signal to the engine control, unit 11 (S10).

The transmission control unit 12 stops updating the voltage value of the battery 4 (S14) until the first update waiting time elapses after the transmission control unit 12 has been energized (No in S12). The update of the voltage value of the battery 4 is restarted when the first update waiting time has elapsed since the transmission control unit 12 has been energized (Yes in S12).

The engine control unit 11 receives the start permission signal sent from the transmission control unit 12 (S16). When the ignition switch 13 receives an instruction for starting the engine 2 from the driver (S18), the engine control unit 11 instructs the engine starting unit 10 to start the engine 2 (S20).

Next, the latter half of the sequence diagram will be described with reference to FIG. 4. A, B, C, and D in FIG. 4 denote continuations of A, B, C, and D in FIG. 3, respectively.

The engine starting unit 10 starts the operation of the engine 2 (S22). The engine control unit 11 instructs the engine starting unit 10 to start the engine 2, and starts sending the start instruction signal to the transmission control unit 12 (S24). The transmission control unit 12 receives the start instruction signal from the engine control unit 11 (S26). While the transmission control unit 12 receives the start instruction signal from the engine control unit 11, the transmission control unit 12 executes the "voltage update processing during the reception of the instruction signal" (S28).

When the engine starting unit 10 starts the engine 2 successfully (S30), the driver returns the ignition switch 13 from the start state to the on state, so that the state of the ignition switch 13 changes from the start state to the on state (S32). Accordingly, the engine control unit 11 stops the sending of the start instruction signal sent to the transmission control unit 12 (S34).

The transmission control unit 12 stops updating the voltage value of the battery 4 (S38) until the second update waiting time elapses after the sending of the start instruction signal has been stopped (No in S36). The transmission control unit 12 restarts updating the voltage value of the battery 4 when the second update waiting time has elapsed after the sending of the start instruction signal has been stopped (Yes in S36).

Flow of Voltage Update Processing during Reception of Instruction Signal

Figure 5:
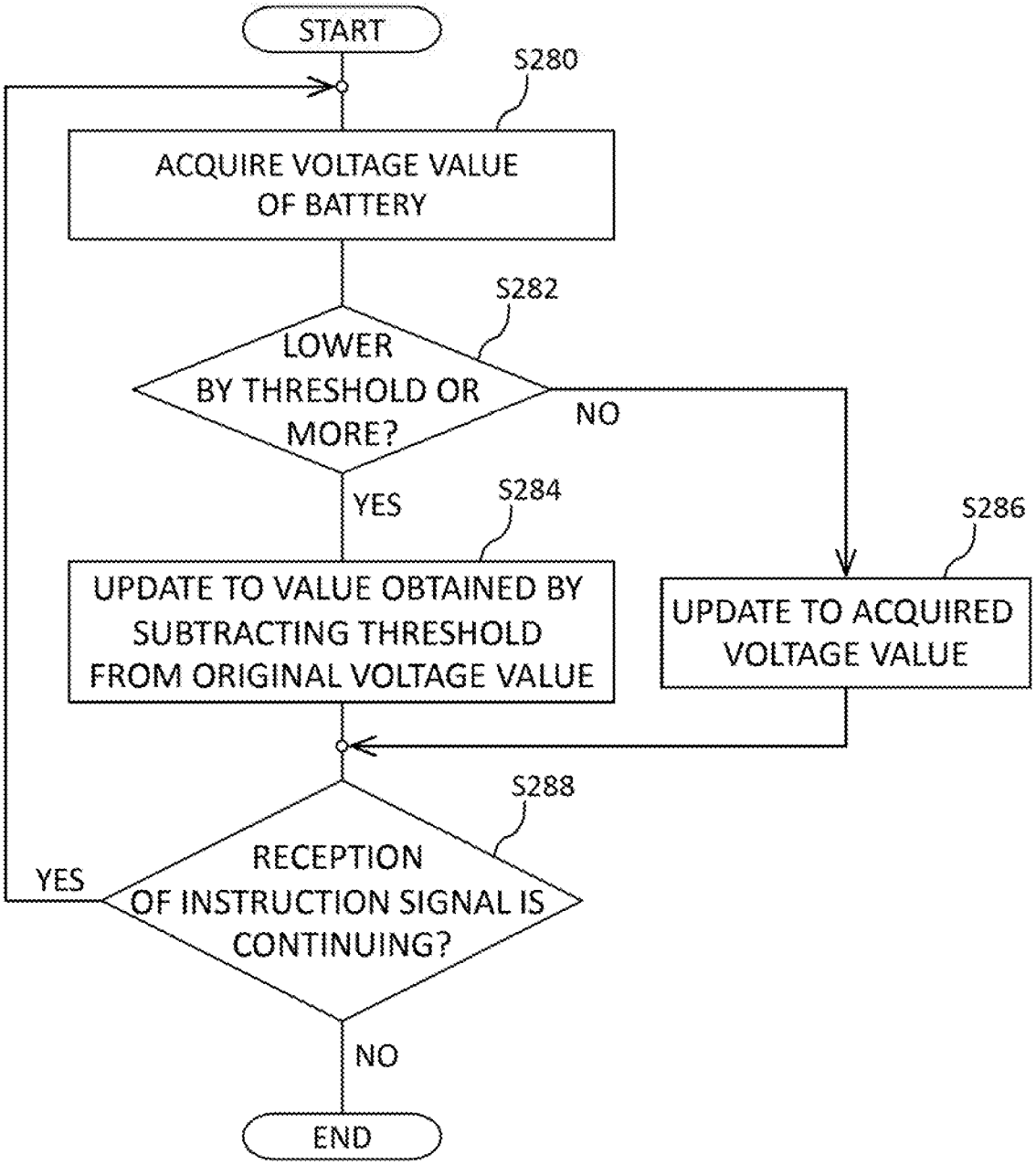
FIG. 5 is a flowchart showing a flow of voltage update processing executed by a transmission control unit during reception of an instruction signal according to the embodiment.

FIG. 5 is a flowchart showing a flow of the voltage update processing executed by the transmission control unit 12 during the reception of the instruction signal according to the embodiment, and shows step S28 in FIG. 4 in detail.

The transmission control unit 12 acquires the voltage value of the battery 4 (S280). In the case where the acquired voltage value is lower than the voltage value before the acquisition b the reference voltage threshold or more (Yes in S282), the transmission control unit 12 updates a obtained by subtracting the reference voltage threshold from an original voltage value as a new voltage value (S284). In the case where the acquired voltage value is not lower than the voltage value before the acquisition by the reference voltage threshold or more (No in S282), the transmission control unit 12 updates the acquired voltage value as the new voltage value (S286).

While continuing to receive the start instruction signal from the engine control unit 11 (Yes in S288), the transmission control unit 12 returns to step S280 and continues the above-described processing. When the reception of the start instruction signal from the engine control unit 11 is completed (No in S288), the processing in the present flowchart ends.

Effect of Control Device 1 according to Embodiment

As described above, the control device 1 according to the embodiment can improve the safety after starting the engine in the vehicle in which the voltage for starting the engine 2 is lower than the voltage for controlling the transmission 3.

The present disclosure has been described using the embodiment. However, the technical scope of the present disclosure is not limited to the scope described, in the above-described embodiment, and various modifications and changes can be made within the scope thereof. For example, a specific embodiment of distributing and integrating devices is not limited to the above-described embodiment, and all or a part thereof may be functionally or physically distributed and integrated in any unit. New embodiments generated from any combination of a plurality of embodiments are also contained in the embodiment of the present disclosure. Effects of the new embodiments generated from the combinations include the effect of the original embodiment.

The present application is based on Japanese Patent Application (JP2017-208140) filed on Oct. 27, 2017 contents of which are incorporated herein by reference.

INDUSTRIAL APPLICABILITY

The control device in the present disclosure is useful in improving the safety after starting the engine of the vehicle.

LIST OF REFERENCE NUMERALS

1 control device
2 engine
3 transmission
4 battery
4A first battery
4B second battery
5 engine key
10 engine starting unit

11 engine control unit
12 transmission control unit
13 ignition switch

The invention claimed is:

1. A control device mounted on a vehicle, the control device comprising:

an engine starter that starts an engine of the vehicle on a condition that power, supplied by battery, has a voltage higher than a preset first drive voltage;

an engine control unit that controls an operation of the engine starter; and a transmission control unit that drives a transmission of the vehicle on a condition that the power, supplied by the battery, has a voltage higher than a preset second drive voltage, the preset second drive voltage being higher than the preset first drive voltage, wherein the transmission control unit sends an engine start permission signal to the engine control unit in a case where the voltage of power supplied by the battery is equal to or higher than the preset second drive voltage, and the engine control unit controls the engine starter to start the engine in response to receiving the engine start permission signal from the transmission control unit.

2. The control device according to claim 1, wherein the transmission control unit measures a voltage value for the voltage of the power supplied by the battery at a predetermined time interval and updates a current value to be the measured voltage value, the control device further comprises an ignition switch that receives a first instruction from a driver of the vehicle for supplying power of from the battery to the engine starter, the engine control unit, and the transmission control unit, and the transmission control unit stops updating the current value until a predetermined first update waiting time has elapsed since the power was supplied by the battery.

3. The control device according to claim 2, wherein the ignition switch further receives a second instruction from the driver for starting the engine, the engine control unit sends a start instruction signal to the transmission control unit while the second instruction is received from the driver, and while the transmission control unit receives the start instruction signal from the engine control unit, the transmission control unit:

determines that the measured voltage value is lower than a prior current value by a reference voltage threshold or more, and in response to the determination, updates the current value to a voltage value obtained by subtracting the predetermined reference voltage threshold from the measured voltage value.

4. The control device according to claim 3, wherein the transmission control unit stops updating the current value until a predetermined second update waiting time has elapsed since the reception of the start instruction signal.

* * * * *